US007665251B1

(12) United States Patent
Lang et al.

(10) Patent No.: US 7,665,251 B1
(45) Date of Patent: Feb. 23, 2010

(54) STRUCTURAL STEEL FRAMED HOUSES WITH GABLE END FRAMES, INTERMEDIATE FRAMES, AND WALL AND ROOF PANELS HAVING PERIMETERS OF C-SHAPED STEEL CHANNELS

(75) Inventors: Steven Lang, 6 Deerfield Ave., Danbury, CT (US) 06810; Joseph Lang, Danbury, CT (US)

(73) Assignee: Steven Lang, Danbury, CT (US)

( * ) Notice: Subject to any disclaimer, the term of this patent is extended or adjusted under 35 U.S.C. 154(b) by 732 days.

(21) Appl. No.: 10/865,593

(22) Filed: Jun. 9, 2004

(51) Int. Cl.
*E04B 7/04* (2006.01)
*E04H 1/02* (2006.01)

(52) U.S. Cl. ..... 52/91.3; 52/93.2; 52/236.6; 52/262

(58) Field of Classification Search ..... 52/270, 52/264, 265, 261, 90.1, 91.1, 91.3, 93.2, 52/236.6, 262
See application file for complete search history.

(56) References Cited

U.S. PATENT DOCUMENTS

| | | | | | |
|---|---|---|---|---|---|
| 1,189,492 | A | | 7/1916 | Schanman | |
| 1,818,418 | A | * | 8/1931 | Millard | 52/263 |
| 1,955,818 | A | * | 4/1934 | Marshall | 52/236.9 |
| 1,958,473 | A | | 5/1934 | Dovell | |
| 2,010,552 | A | * | 8/1935 | McDermott | 52/236.6 |
| 2,445,491 | A | | 7/1948 | Moloney | |
| 3,668,828 | A | * | 6/1972 | Nicholas et al. | 52/92.1 |
| 4,312,160 | A | * | 1/1982 | Wilbanks | 52/92.1 |
| 4,342,177 | A | * | 8/1982 | Smith | 52/93.1 |
| 4,408,423 | A | * | 10/1983 | Lautensleger et al. | 52/90.1 |
| 4,514,950 | A | | 5/1985 | Goodson | |
| 4,610,114 | A | * | 9/1986 | Rodriguez | 52/93.1 |
| 4,697,393 | A | * | 10/1987 | Madray | 52/93.2 |
| 4,894,964 | A | * | 1/1990 | Thrift et al. | 52/93.1 |
| 5,028,072 | A | * | 7/1991 | Lindsay | 280/789 |
| 5,526,614 | A | | 6/1996 | Huang | |
| 5,577,353 | A | * | 11/1996 | Simpson | 52/92.2 |
| 5,590,505 | A | * | 1/1997 | Bogle | 52/836 |
| 5,600,924 | A | * | 2/1997 | Forsberg | 52/93.2 |
| 5,657,583 | A | * | 8/1997 | Tennant | 52/79.5 |
| 5,657,606 | A | * | 8/1997 | Ressel et al. | 52/690 |
| 5,826,379 | A | * | 10/1998 | Curry | 52/79.1 |
| 5,987,842 | A | | 11/1999 | Klein | |
| 6,112,473 | A | | 9/2000 | Pingel | |
| 6,276,094 | B1 | * | 8/2001 | Hays | 52/79.1 |
| 6,167,674 | B1 | | 9/2001 | Nanayakkara | |
| 6,519,900 | B1 | * | 2/2003 | Pierce | 52/66 |
| 6,604,328 | B1 | * | 8/2003 | Paddock | 52/93.1 |
| 6,694,699 | B2 | * | 2/2004 | Dowland | 52/741.13 |
| 2001/0037621 | A1 | | 11/2001 | Seng | |
| 2002/0194811 | A1 | | 12/2002 | Shimizu | |
| 2003/0024174 | A1 | * | 2/2003 | Bonds et al. | 52/79.1 |
| 2003/0033759 | A1 | | 2/2003 | Pina | |

(Continued)

*Primary Examiner*—Gay Ann Spahn
(74) *Attorney, Agent, or Firm*—Ware, Fressola, Van Der Sluys & Adolophson, LLP

(57) ABSTRACT

Steel frames formed of rolled steel I-beams are connected by steel framed wall panels spanned by steel studs, and covered by steel framed roof panels spanned by steel purlins, making a structural frame completely formed of steel components bolted together. All components are precut and predrilled before transport to a construction site. A crane is used to raise steel frames and steel framed roof panels into position for bolted assembly, reducing construction times to absolute minimums. Entire structure is virtually lightning-proof, wind-proof, and earthquake resistant.

13 Claims, 21 Drawing Sheets

U.S. PATENT DOCUMENTS

2003/0089066 A1* 5/2003 Nelson ..... 52/424
2004/0200172 A1* 10/2004 Beck et al. ..... 52/506.03
2004/0255535 A1* 12/2004 Herren ..... 52/348
2005/0284038 A1* 12/2005 Jenkins ..... 52/90.1

* cited by examiner

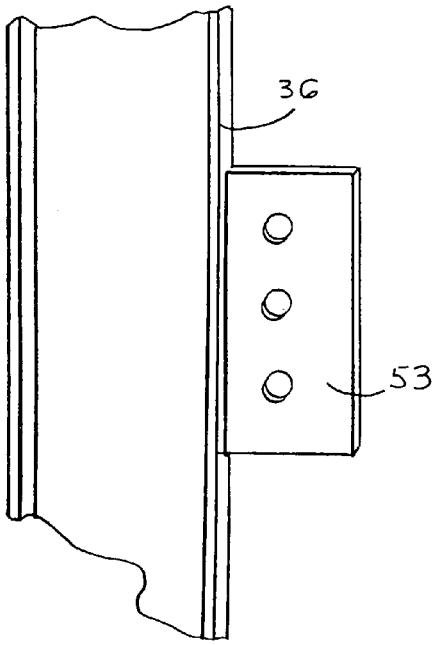
FIG. 20
FIG. 21
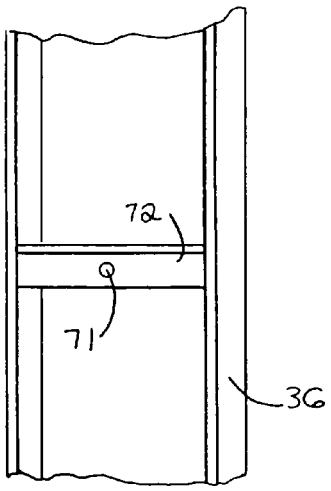
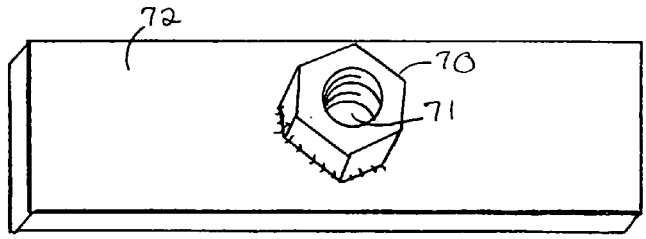
FIG. 22

STRUCTURAL STEEL FRAMED HOUSES WITH GABLE END FRAMES, INTERMEDIATE FRAMES, AND WALL AND ROOF PANELS HAVING PERIMETERS OF C-SHAPED STEEL CHANNELS

This invention concerns the construction of residential homes for single families, large or small. Generally such homes are limited to two or three stories, often surmounted by an attic, and they may have a full height basement all or partly extending below grade. The homes of this invention are steel-framed homes with I-beam frames, steel wall panels and steel roof panels.

FIELD OF THE INVENTION

The homes embodying this invention are provided with steel frames of rolled structural steel I-beams, which may be precut and drilled, trucked to the building site, and assembled on site for erection.

Outer gable end wall panels and outer side wall panels having peripheral rims formed of steel channels, and steel studs framing door and window openings and spaced studs, are rigidified by diagonal bands and assembled between steel I-beam frames. All of the columns, beams and outer wall panels are successively bolted together, forming an external steel frame spanned only by floor beams and roof beams, essentially an exoskeleton.

RELATED ART

The use of rolled structural steel for columns and beams in constructing residential houses has been proposed since the 1930's, perhaps influenced by the wide use of structural steel in framing tall office buildings. Dovell U.S. Pat. No. 1,958,473 shows heavy I or H beams and columns, with "cantilever" arms or beams rigidifying beam-column connections. Moloney U.S. Pat. No. 2,445,491 employs extremely heavy rolled beams and columns, with back-to-back channels sandwiching wood nailing strips incorporated throughout, for anchoring wood flooring, ceiling and wall panels to them. Goodson U.S. Pat. No. 4,514,950 shows many narrow one-story or two-story wall panels with horizontal studs spanning them, minimizing crane time by requiring cranes only for assembling higher stories. Pingel U.S. Pat. No. 6,112,473 likewise uses modular prefabricated wall and roof units stacked like building blocks, perhaps inspired by the "Habitat 67" apartment building at Montreal Expo 67.

BRIEF SUMMARY OF THE INVENTION

Residential construction methods were basically unchanged up to the end of the 20th century. Wood prices are rising rapidly and the forests will not be able to produce wood fast enough to support the fast growing population. However, after years of experience in the construction field, it has been possible to design, develop and evaluate several types of structural steel framed houses, preferably a 3-story A-frame and 2-story Colonial, which address these concerns. Iron was carefully chosen as the building material for its maximum strength and durability. Iron is a totally recyclable material and there is a considerably good supply in today's modern society; we need not wait 60 years for enough lumber to grow.

The 3-story A-frame house and the 2-story Colonial shown in the drawings are framed of structural steel. Parts are welded and the adjacent units are bolted together with high tensile strength bolts. The use of iron in modern technology allows for faster, more accurate fabrication then conventional methods. This new method allows us to fly, with the imagination of design to lead us into the 21st century. The structural steel frames stand up independently and do not need interior bearing walls to support the frame and the floor system. These houses have 30 foot clear spans inside. This allows the purchaser/owner to determine the size of the rooms. The purchaser will be able to lay down and mark the furniture and decide on the size of the living room, kitchen, etc. All interior walls can be changed and modified quickly.

In the 3-story A-frame design, the first and the second story ceiling height is up to 122 inches, depending upon the choice of exposed beams or drop ceilings. The third story ceiling height to the peak is 14 feet high.

In both designs, the outside walls are 8 inches plus thick, which allows 9 inches of insulation for an insulating rating of R-30. Conventional buildings are rated between R-11 and R-19. The heating and cooling cost savings factor is up to 60 percent. Also, the soundproof factor is greater than in conventional homes.

Another advantage is the fact that structurally the house is fireproof, termite resistant and is able to withstand a substantial earthquake. Insurance premiums are low, because of the structure's fire resistance, strength and durability. With a structural steel frame house, fire damage is minimal compared to a wood framed house; it simply has less material to burn. In most cases the frame will stand, allowing rebuilding to be faster and keeping costs low.

The sturdy steel structure allows the house to have outside walls almost totally designed with glass, allowing for fantastic views. A glass house, cosmetically, for its exterior and interior, can be designed as a type of hunting lodge, or a raw stone and brick combination can be used as in an English Tudor style.

The construction methods are simple because of the way the whole structure is designed. In shop fabrication, all members are precut, prewelded and predrilled. The entire house is shipped to the building site in a package and assembled on the job site, quickly and accurately.

These houses are shipped in a package, disassembled in pieces, and do not take up a lot of room.

They are cost effective because they cut down on needed storage space compared to pre-fab modular homes and yet they offer accurate, fast assembly times.

With the A-frame house, you have an option to have balconies on the A-frame side or on the steep roof side, on the second and third floor. The A-frame has a huge overhang of 70 inches all the way around the house. This feature adds to the unusual character of this design.

The 2-story Colonial structural steel framed house preferably has a 30 foot clear span interior with a ceiling height of 107 inches, and optional exposed beams or a lower ceiling, with an overhang of 28 inches. The shop fabrication and erection methods are the same methods used for both designs.

A steel frame home, because of the design and the material used, requires minimum maintenance. They are termite and insect proof. The wall thickness and ceiling thickness design allows all utilities to be easily installed and maintained.

These houses are affordable, stronger than wood-framed houses, and lighter than wood-framed houses. Being made of steel, they are more versatile in design, are made of recyclable materials, have excellent wind and snow load durability, and can survive earthquake shocks. In earthquake areas, a steel foundation increases the survival factor during earthquakes. The estimated calculation for earthquake endurance is up to Number 4.

This design allows many opportunities for new ideas and innovative styles which can be merged or created in either design. Examples: Rustic wilderness cabins, total glass houses, 32 foot high family room areas with balconies looking down from the inside living area to the fireplace area, sunken living room areas, hand-forged iron spiral staircases, wood and iron combinations, lofts, totally prefabricated swimming pool inside with waterfalls, with an optional sliding floor, over the pool, thus completely camouflaged.

Accordingly, it is a principal object of the present invention to provide economical and effective methods for construction of sturdy, spacious residential homes of ergonomically appealing style with minimized construction time.

Another object of the invention is to provide rigid steel frames anchored together by steel-rimmed external gable end panels, side panels and roof panels to produce an exoskeleton structure with high ceilings and ample clear internal spans, facilitating customized internal partitions since internal bearing walls are not needed.

Still another object of the invention is to provide extremely robust residential homes with maximum capability for withstanding unexpectedly high loads produced by such natural occurrences as hurricanes, tornados, blizzards, earthquakes or mudslides.

A further object of the invention is to produce such residential dwellings with ample insulation ratings as high as R-30, and effective soundproofing.

Other objects of the invention will in part be obvious and will in part appear hereinafter.

The invention accordingly comprises the features of construction, combination of elements, and arrangements of parts which will be exemplified in the construction hereinafter set forth, and the scope of the invention will be indicated in the claims.

A-FRAME AND COLONIAL HOME DRAWINGS

For a fuller understanding of the nature and objects of the invention, reference should be made to the following detailed description taken in connection with the accompanying drawings, in which:

FIG. 12A is a perspective view of the same colonial home with wall panels and end panels installed, and a roof panel being lowered into place;

FIG. 20 is an enlarged fragmentary elevation view of a frame column showing its greatly simplified welded cantilever support plate of FIG. 14 providing end support for the second story floor beam;

FIG. 21 is an enlarged fragmentary elevation of a frame column showing the welded anchor plate securing the wall panel to the column;

FIG. 22 is a greatly enlarged perspective view of the anchor plate shown in FIG. 21;

BEST MODES FOR CARRYING OUT THE INVENTION

The drawings of an A-frame home embodying the present invention, FIGS. 1 through 9A, illustrate the concepts and the philosophy of the invention. Much of the same philosophy and similar concepts are employed in the design of the two-story colonial home shown in FIGS. 10 through 28.

Foundation Sill Beams

Figure 4:
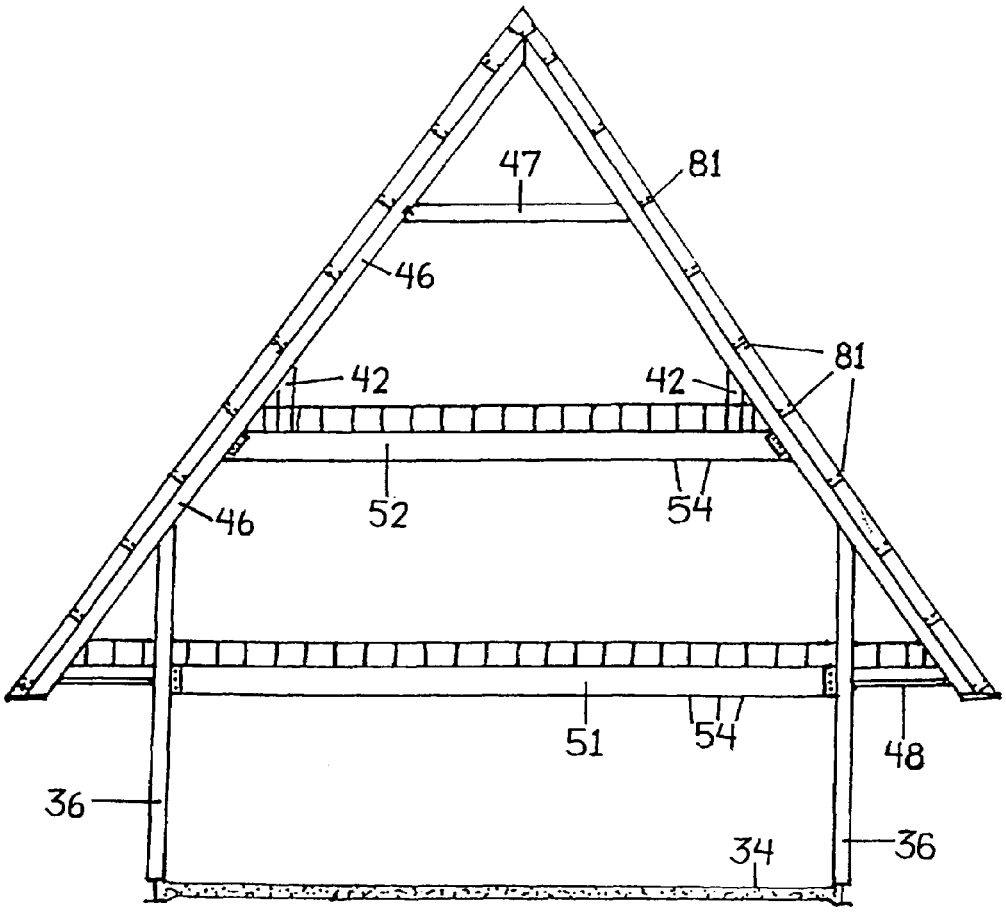
FIG. 4 is a similar elevation view of an internal A-Frame, showing floor, ceiling and roof construction.
Figure 5:
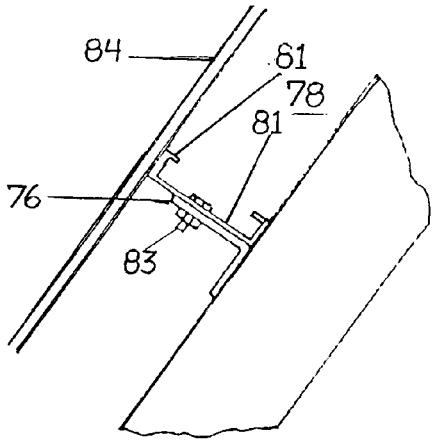
FIG. 5 is an enlarged fragmentary cross-sectional elevation view of construction details of the roof construction respectively.

A foundation sill beam 31, either an I-beam or a wide-flange or "H"-beam, preferably provides the level foundation for the balance of the steel frame; straight segments of sill beam 31 delineate the periphery of the building. They may rest on piers 32 (FIGS. 2 and 10) defining a basement excavation, or such piers may be simply embedded in earth. Alternatively, sill beams 31 may rest on a masonry foundation wall 33 (FIG. 2) enclosing a basement underlying the building, or they may define or enclose the rim of a concrete slab 34 (FIG. 4).

I-Beam Columns and End Plates

Upstanding rolled steel beams, either I-beams or H-beams (wide flange beams) are employed as vertical columns 36 having their lower ends positioned on the sill beams 31. A cap or end plate 37 (FIG. 23) spans the open lower end of each column 36, juxtaposed to cover the end surfaces of both its flanges 38 and web 39, as shown at the bottom of FIG. 23; plate 37 is preferably welded in place to form an open box end at the lower end of column 36.

Figure 9:
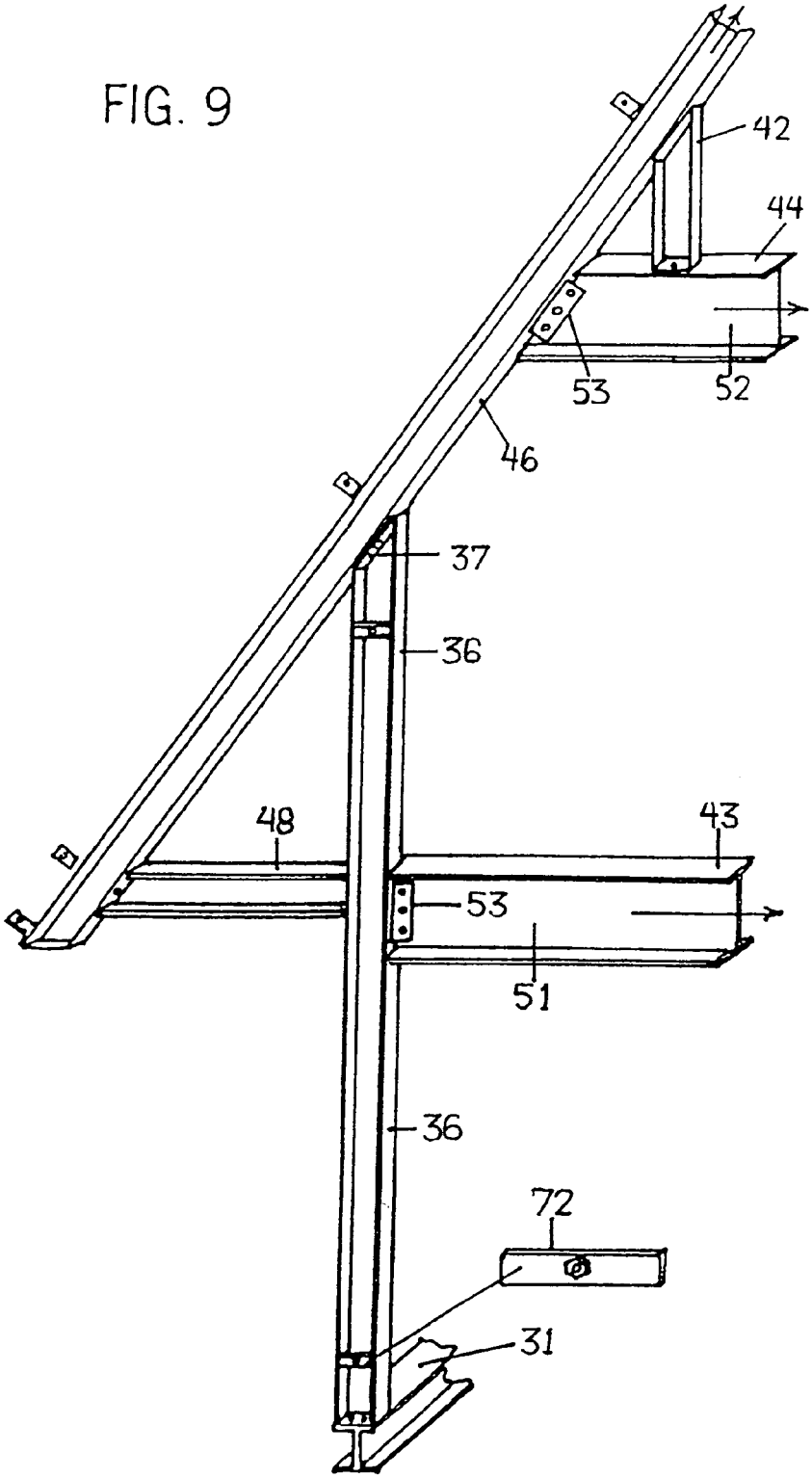
FIG. 9A is a corresponding isometric view of the roof members connected to the column of FIG. 9.
Figure 9A:
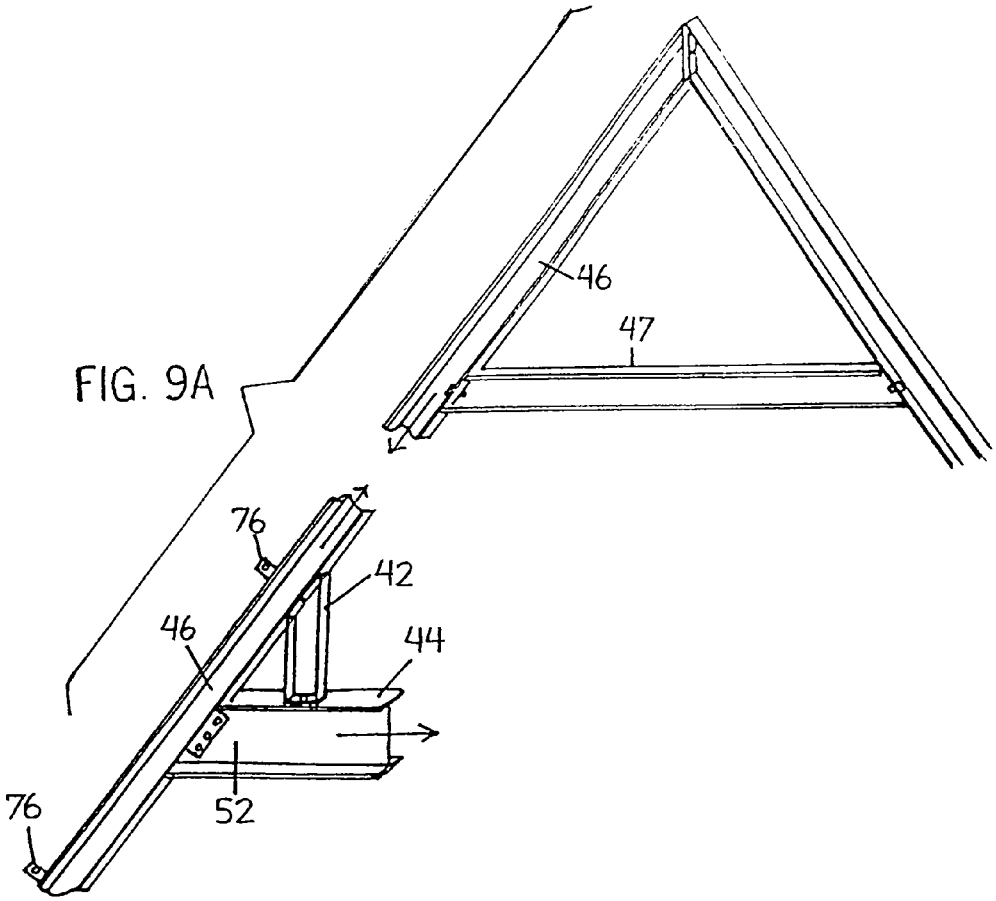
Figure 10:
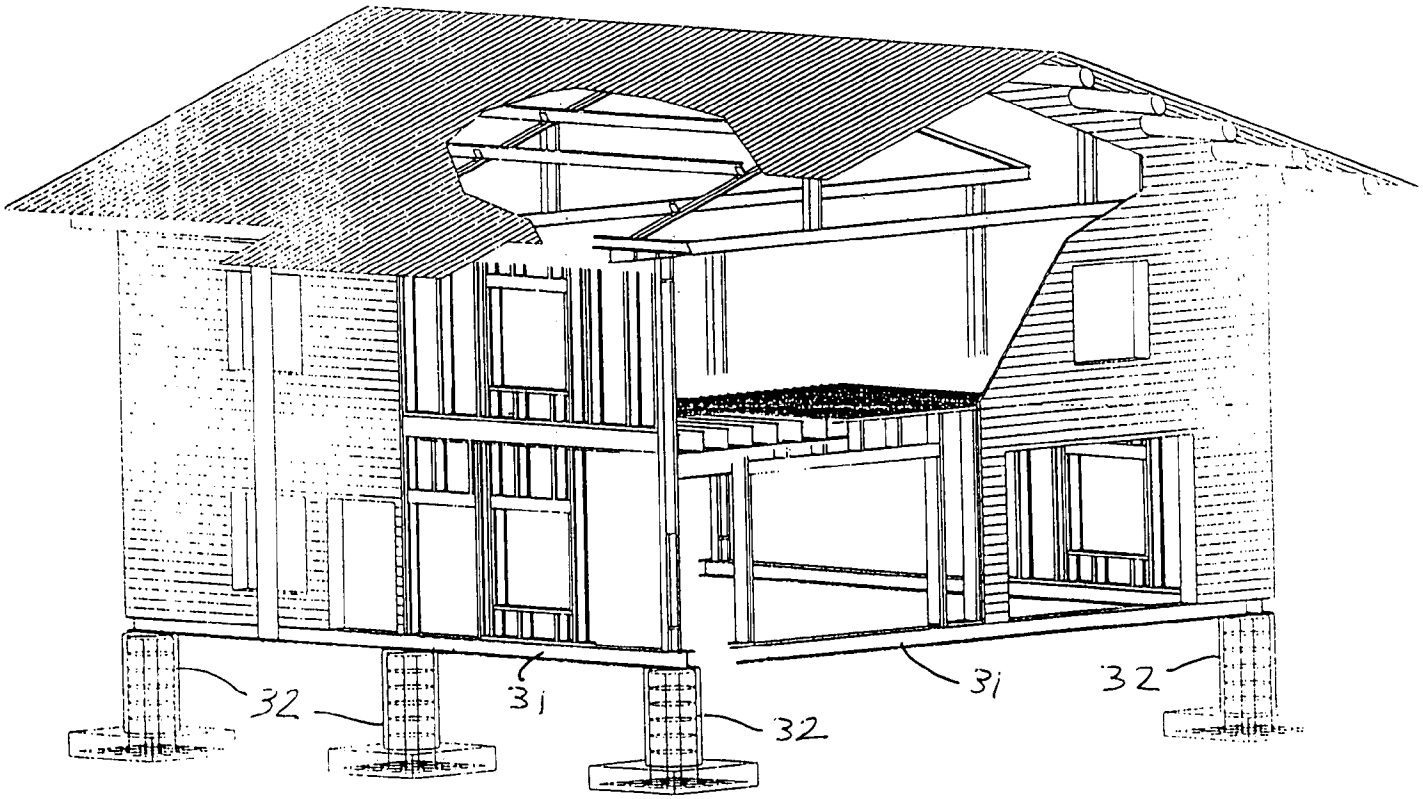
FIG. 10 is a schematic isometric diagram, partially broken away, of a colonial home embodying the present invention.
Figure 14:
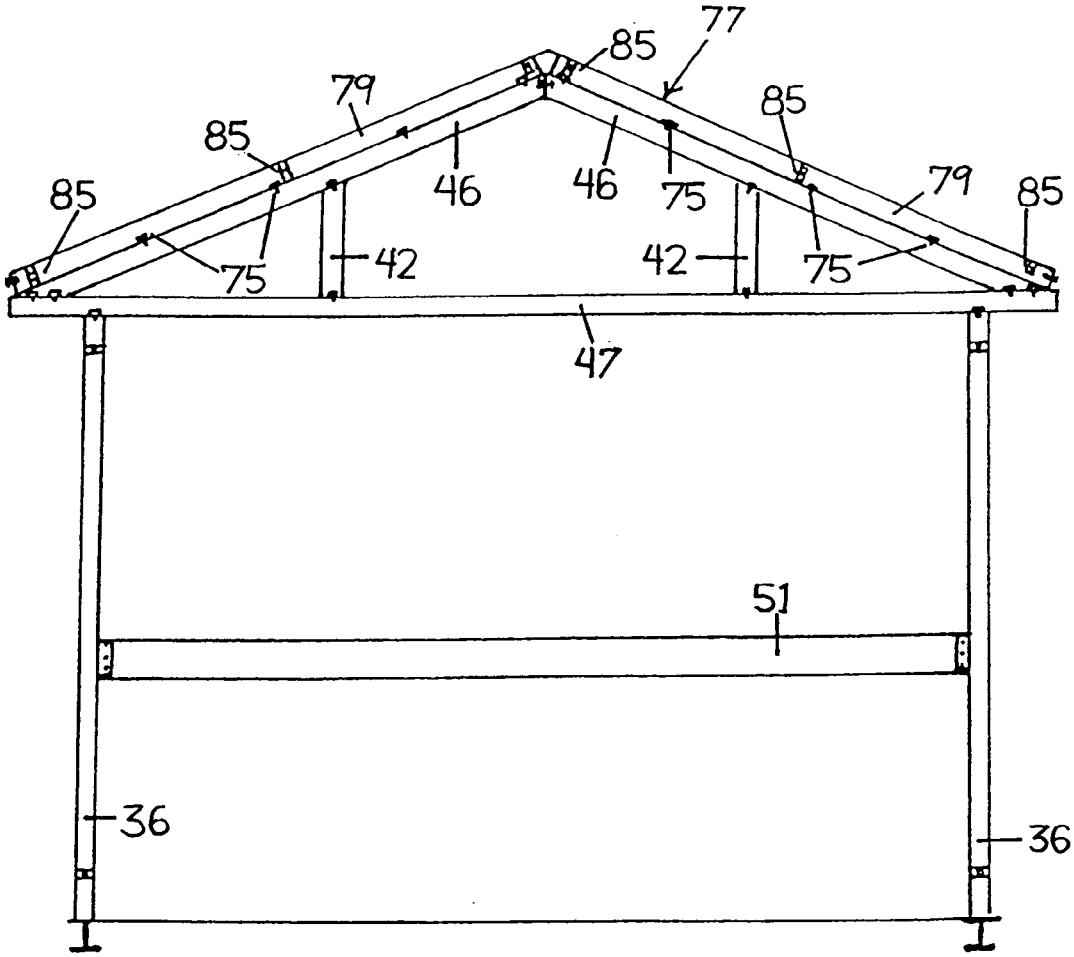
FIG. 14 is an elevation view of a single structural steel exoskeleton frame for the colonial home.
Figure 16:
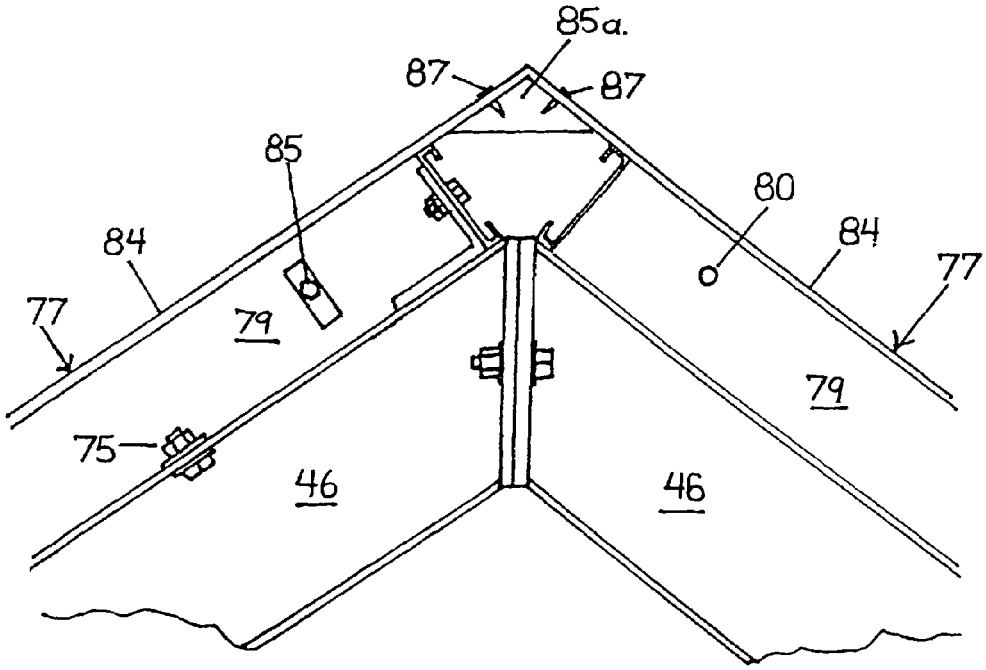
FIG. 16 is a fragmentary enlarged elevation view showing the peak construction details of the roof of the colonial home.
Figure 23:
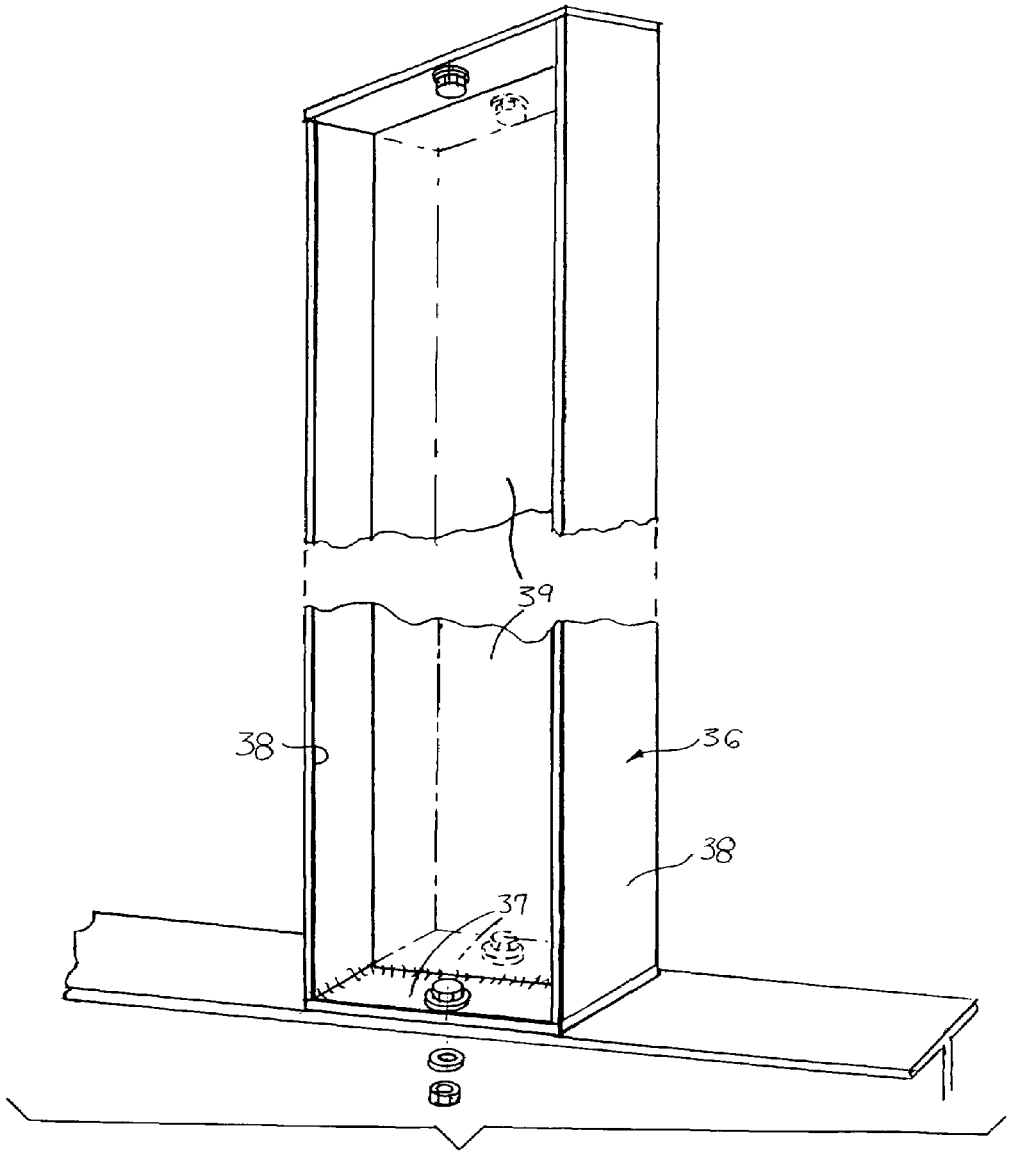
FIG. 23 is an enlarged view, partially broken-away of the short queen post roof column upstanding between the horizontal roof beam and the slanting upper roof beam.
Figure 24:
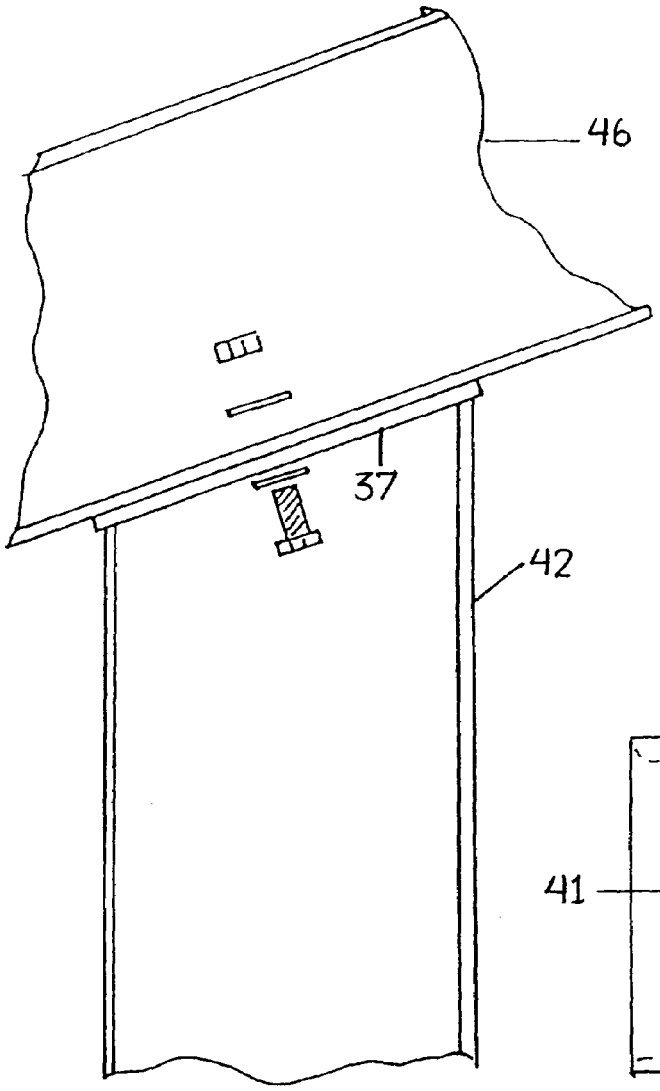
FIG. 24 is an enlarged fragmentary elevation view of the upstanding short queen post roof column and its anchored attachment to the overlying slanted roof beam, as shown in FIG. 14.
Figure 25:
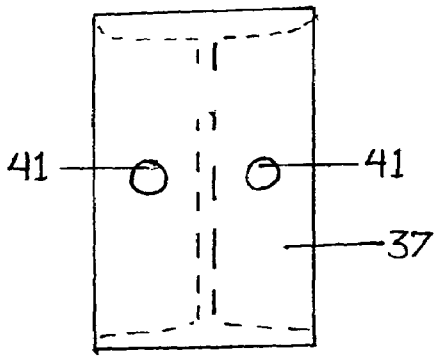
FIG. 25 is a corresponding plan view of the top plate, welded to the upper end of the upstanding short roof column, forming the bolted attachment to the overlying roof beam, as shown in FIG. 24.
Figure 27:
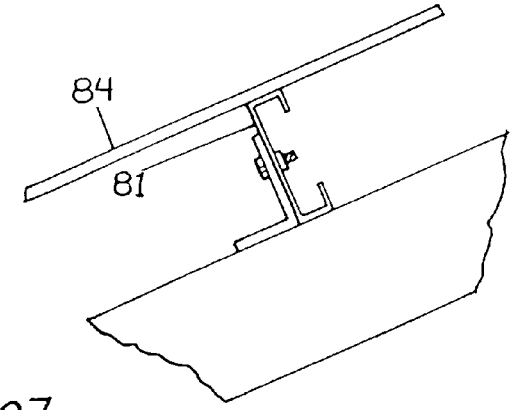
FIG. 27 is a fragmentary cross-sectional elevation view showing construction details of the ceiling construction.

Two bolt holes 41 are formed in the cap or end plate 37, flanking web 39 as indicated in FIGS. 23 and 25. As shown in FIGS. 9 and 9A, counterparts of end plate 37 are welded to the upper end of column 36, to both ends of queen post 42 between the third story floor beam and rafter beam 46, to both ends of horizontal brace beam 48 between column 36 and rafter beam 46, and to both ends of third story ceiling beam or tie beam 47, as well as to the uppermost ends of the I-beam rafters 46, which are joined together by bolts at the peak of both the A-frame and colonial homes. (FIGS. 9A, 14 and 16).

Intermediate Frames

Figure 1:
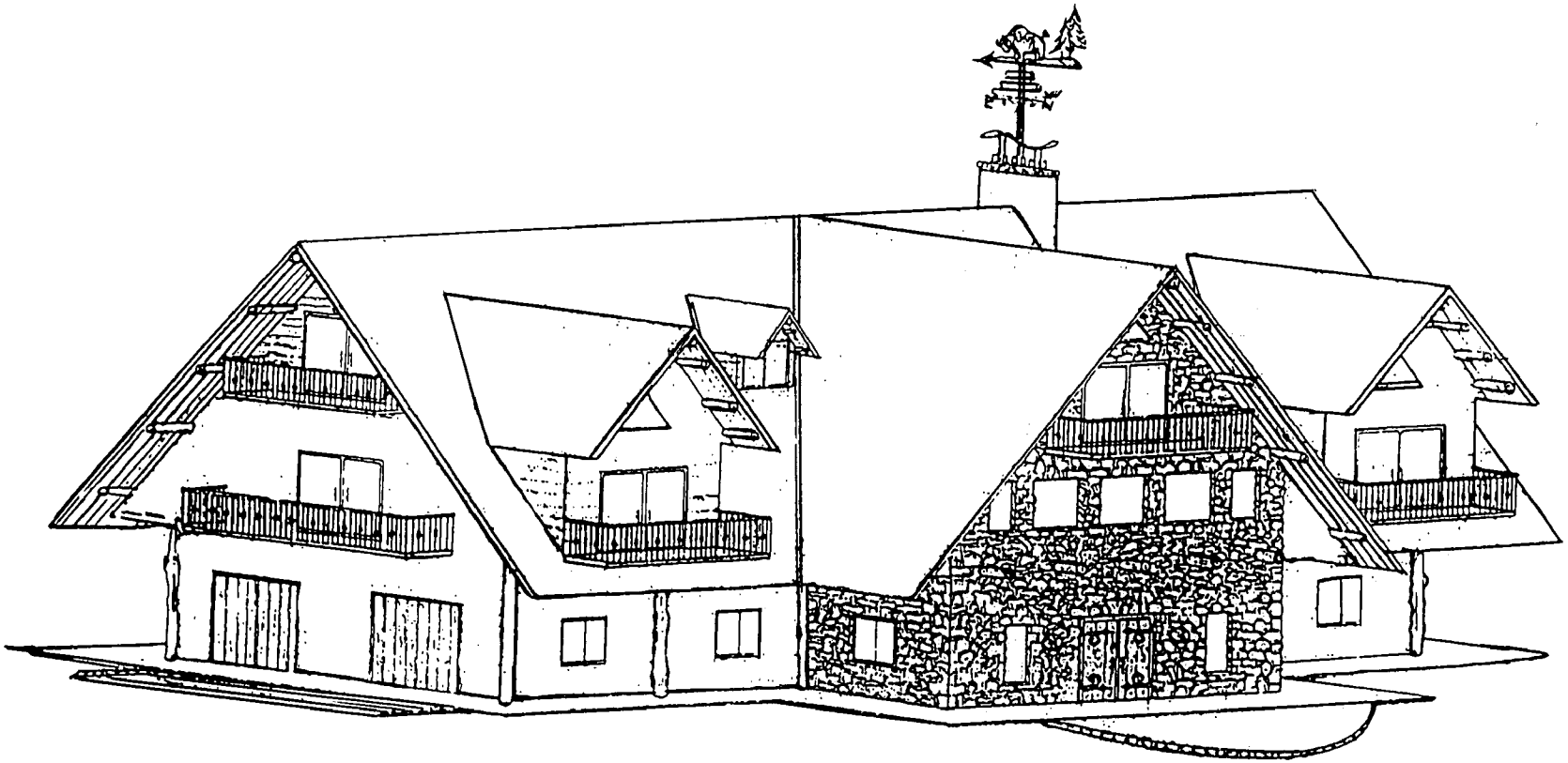
FIG. 1 is an isometric view of an A-Frame home embodying the present invention.
Figure 2:
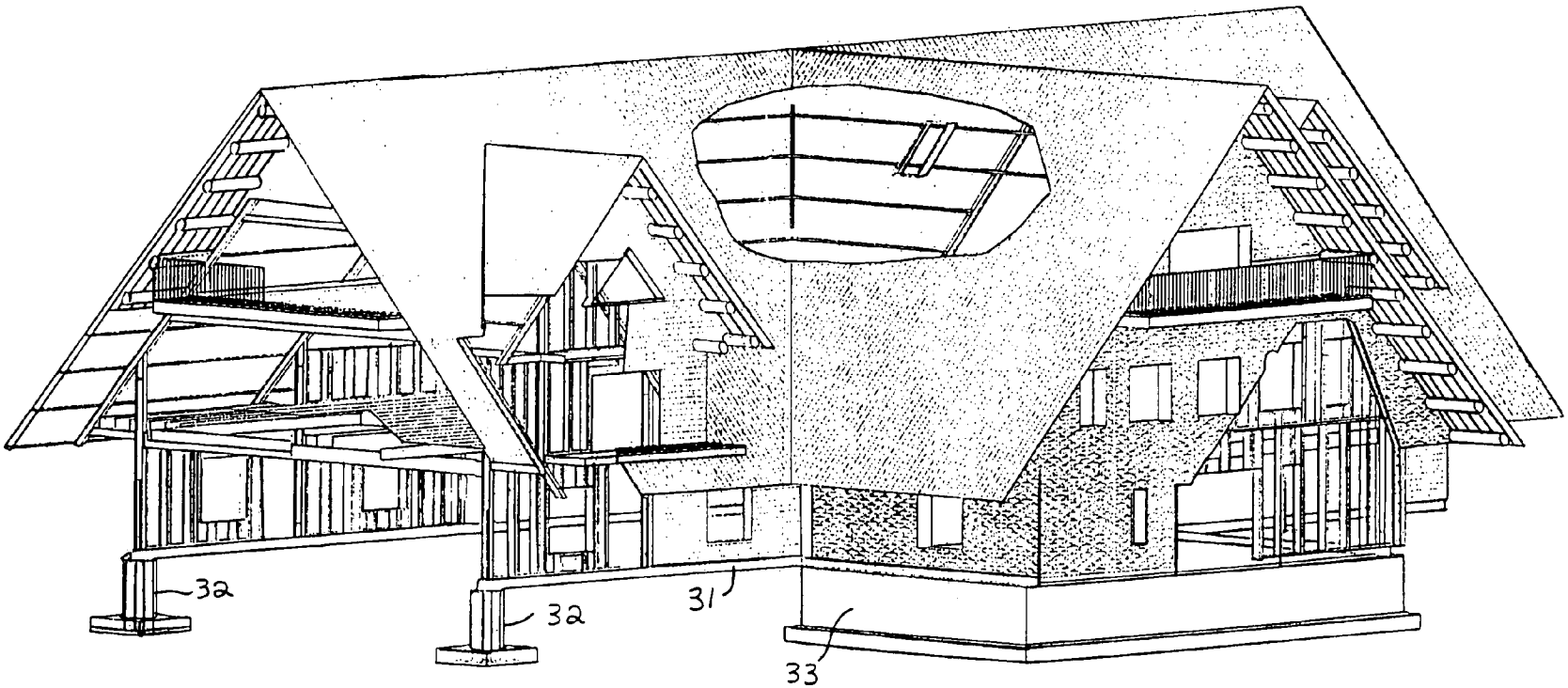
FIG. 2 is an isometric view, of a similar A-Frame home, partially cut away, showing construction details.
Figure 3:
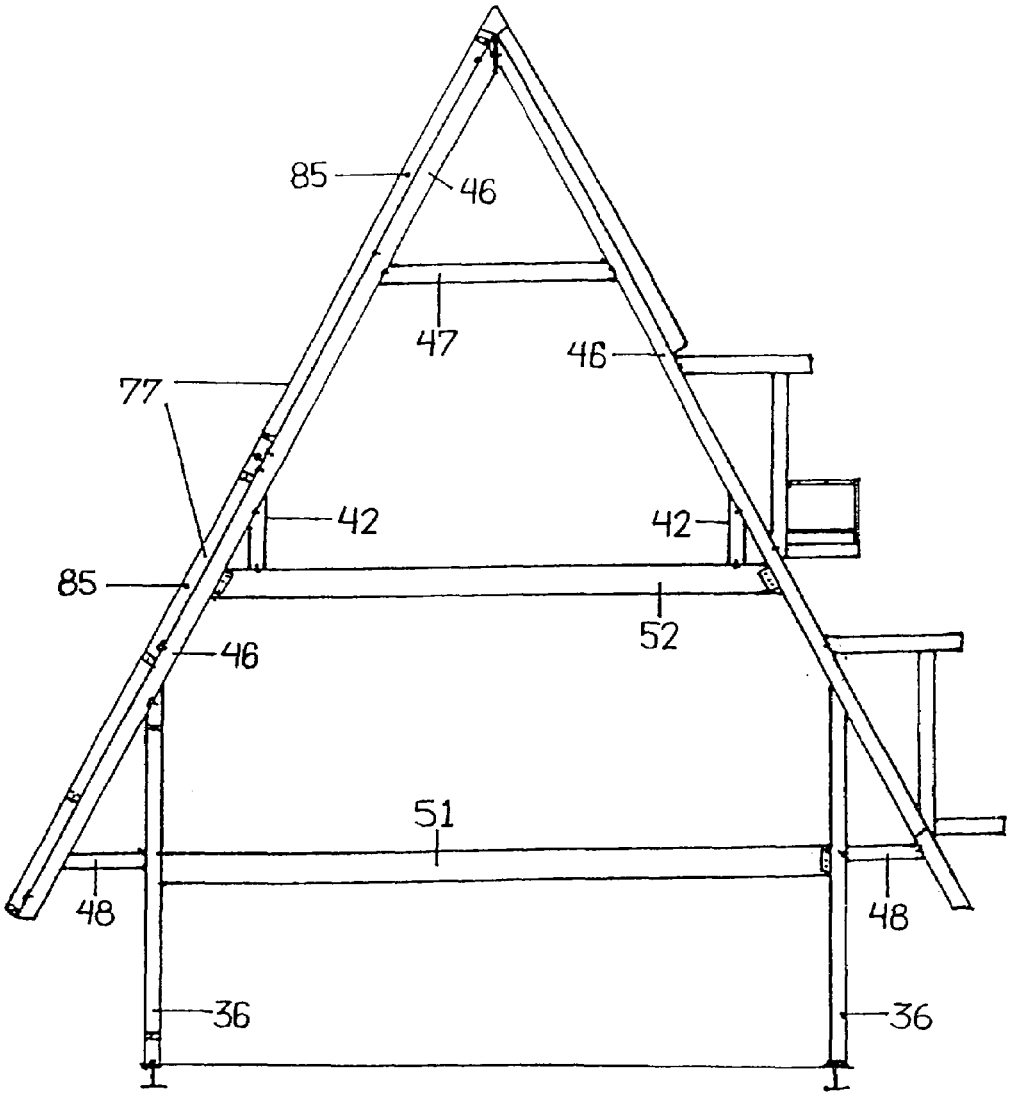
FIG. 3 is an elevation view of a single exoskeleton A-Frame for such a home, showing details of frame construction.
Figure 11:
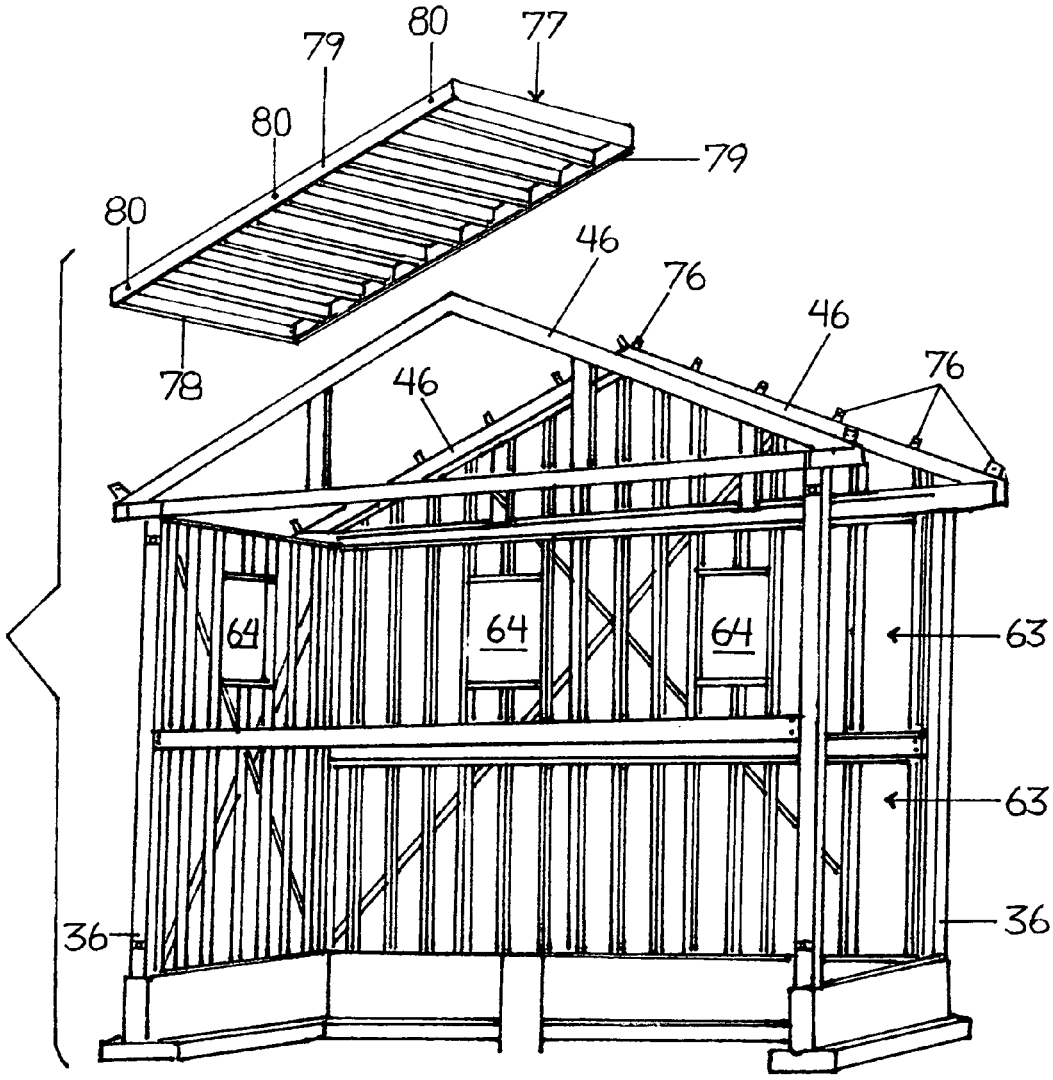
FIG. 11 is a perspective view of the colonial home in the initial stages of its construction.

In each of these end plates 37, the bolt holes 41 are predrilled both in the plates and in the adjoining column, beam or rafter, simplifying the bolting assembly steps at the building site as in the frames shown in FIGS. 3, 9 and 9A assembled. The frame shown in FIG. 3, like the frame nearest the viewer in FIG. 11, is an "intermediate" frame since there is no beam tying the lower ends of its two columns 36 together. This leaves a wide clear span to accommodate extra vertical height for an indoor swimming pool or the like.

End Frames

The Colonial home frames shown remote from the viewer in FIG. 11 and as an elevation view in FIG. 14, like the A-frames shown in FIGS. 3 and 4, also lack any horizontal foundation I-beam or H-beam joining the lower ends of their columns 36. These frames lacking underlying horizontal foundation beams may also be employed as gable end frames, as shown in FIG. 11, since their lower column ends will rest either on a masonry foundation 33 (FIG. 11), or on a horizontal I-beam or H-beam foundation beam 31, as shown in FIGS. 3, 4 and 14, extending under the sidewalls of the home, as shown in FIGS. 2, 9, 10 and 19.

Floor Beams

Figure 17:
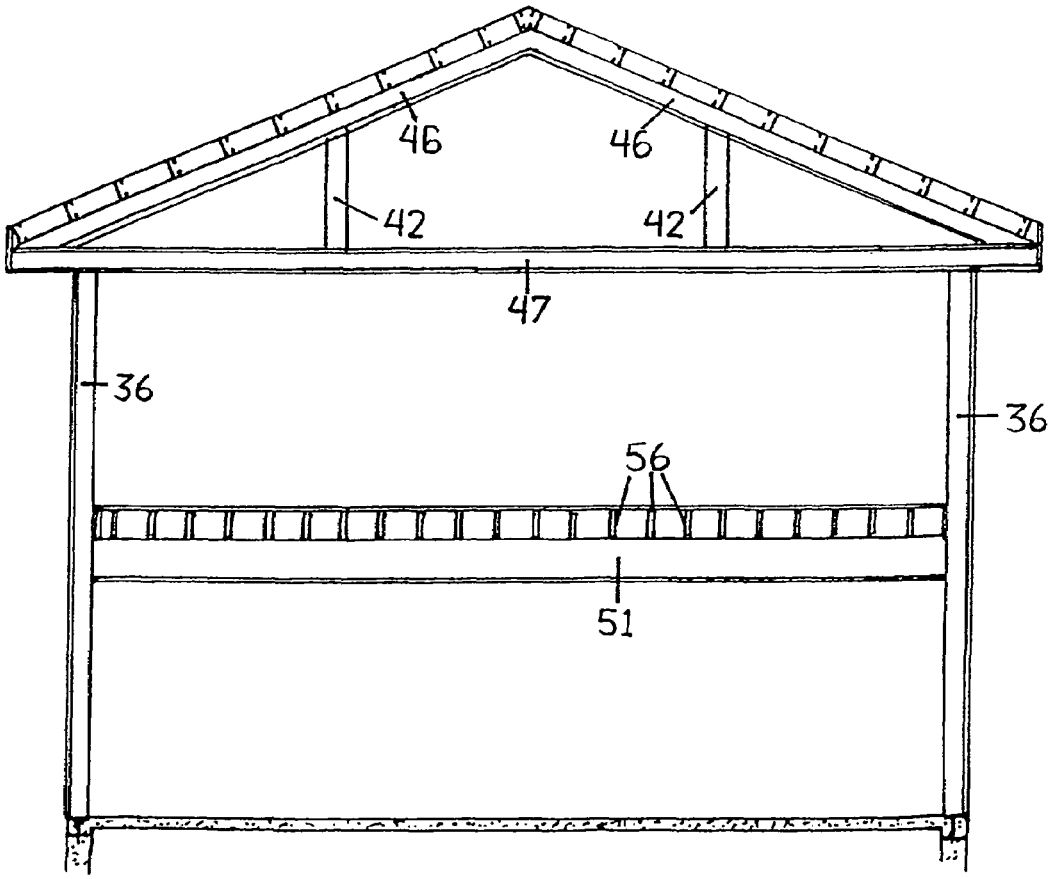
FIG. 17 is an elevation view of an internal frame, showing floor, ceiling and roof construction details.

Second story floor beam 51 and third story floor beam 52 from the A-frame home are shown in FIGS. 3, 4, 9 and 9A. Corresponding second story floor beams 51 for the two-story colonial home are shown in FIGS. 14 and 17.

Floor beams must carry static loads of furniture and also dynamic loads of human occupants. At times, many additional humans may be present in upper floor rooms, and the floor beams are illustrated with 15 or 18 inches in the depth of the beams, as compared to 8 or 10 inches in depth of the I-beams forming the columns 36, queen posts 42, rafters 46, short bracing beams 48 and third story ceiling beams 47.

Floor beams 51 and 52 have their ends bolted to flange plates 53 which are edge welded to the adjacent flange of a column 36, as shown in FIG. 20 and in FIGS. 3, 4, 9, 9A and 14. The floor beams are predrilled with holes aligned with the holes in flange plates 53, and are preferably connected to the flange plates by ¾" steel bolts, sturdily anchoring the floor beams to their supporting columns and minimizing the floor beams' deformation under fixed or live loads.

Ceiling and Floor Details

Figure 7:
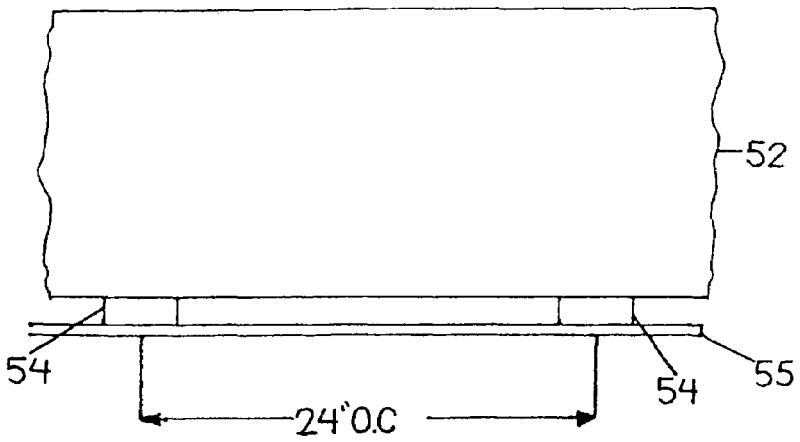
FIG. 7 is an enlarged fragmentary cross-sectional elevation view of construction details of the ceiling construction.
Figure 8:
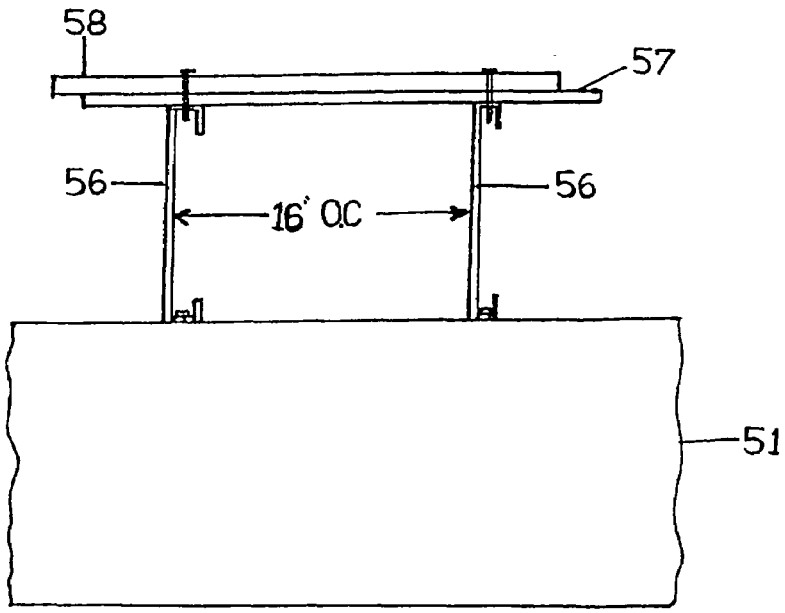
FIG. 8 is an enlarged fragmentary cross-sectional elevation view of construction details of the floor construction.

As shown in FIGS. 7 and 8, the interior details of the A-frame home utilize conventional materials. Purlins 54 anchored to the undersides of the floor beams 51 and 52 support standard panels of ⅝" thick sheetrock 55, held by screws ready for taping and painting (FIG. 7).

12" 14 Gauge C channels upstanding on their flanges, spaced 16" on centers, form floor rafters 56 atop floor beams 51 and 52, as shown in FIGS. 4 and 8. ⅝" plywood panels 57 resting on these floor rafters 56 form the underfloor, and 1" thick wood flooring 58 overlies the plywood underfloor panels 57 (FIG. 8).

These same interior construction details are also incorporated in the second story floor beam 51 in the colonial home (FIG. 17). Purlins 54, sheetrock 55, floor rafters 56, plywood underfloor 57 and wood flooring 58 are thus all shown in FIG. 17. In FIG. 29, alternative wood rafters 12" on centers are shown screwed or nailed to upstanding 2×2 steel angles end welded to the flat upper flange of second story floor I-beam 51; plywood underfloor 57 and wood flooring 58 are the same as in FIG. 17.

Wall Panels

Figure 12:
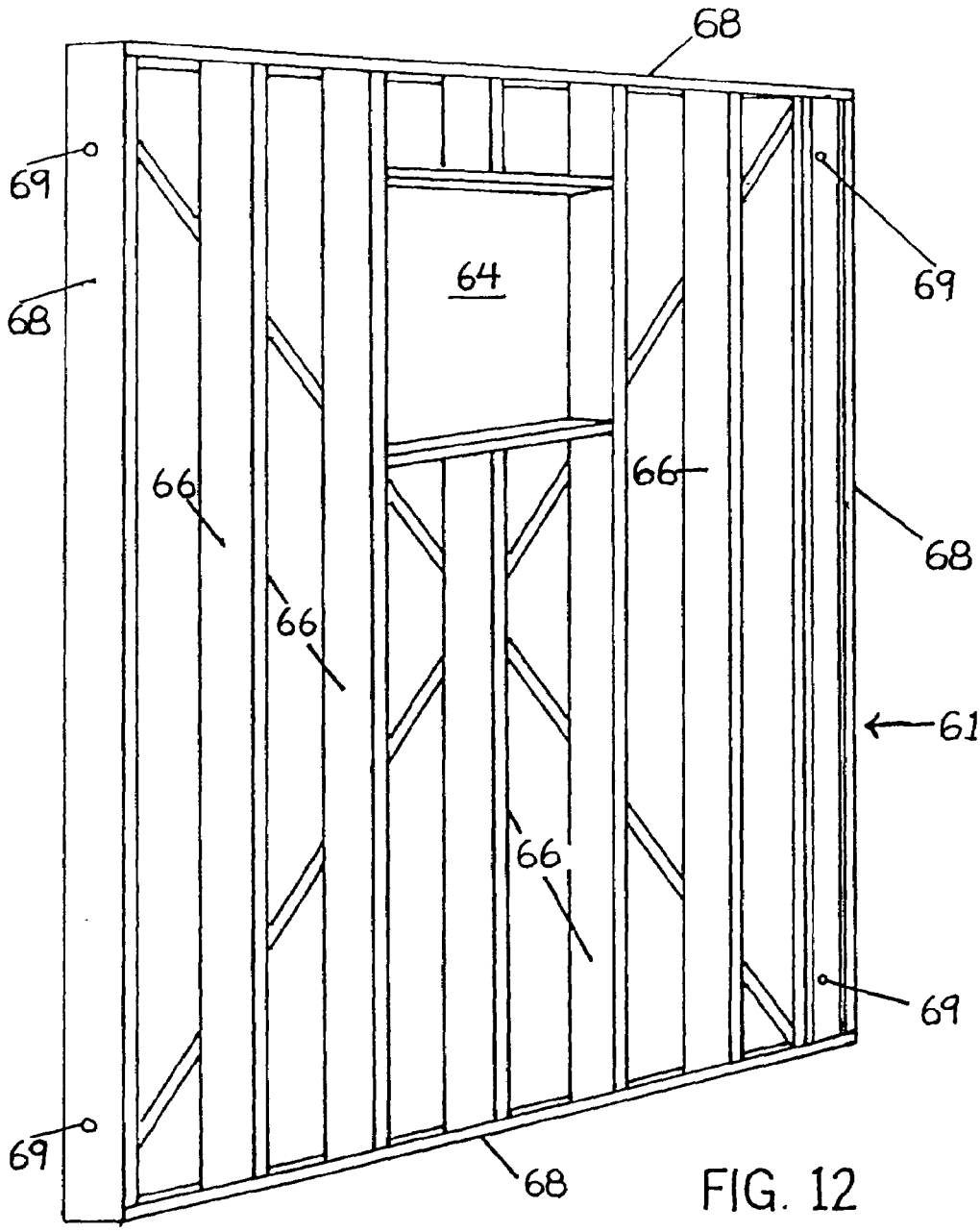
FIG. 12 is a perspective view of a two-story-tall wall panel ready for installation, as shown at the left side of FIG. 11.
Figure 13:
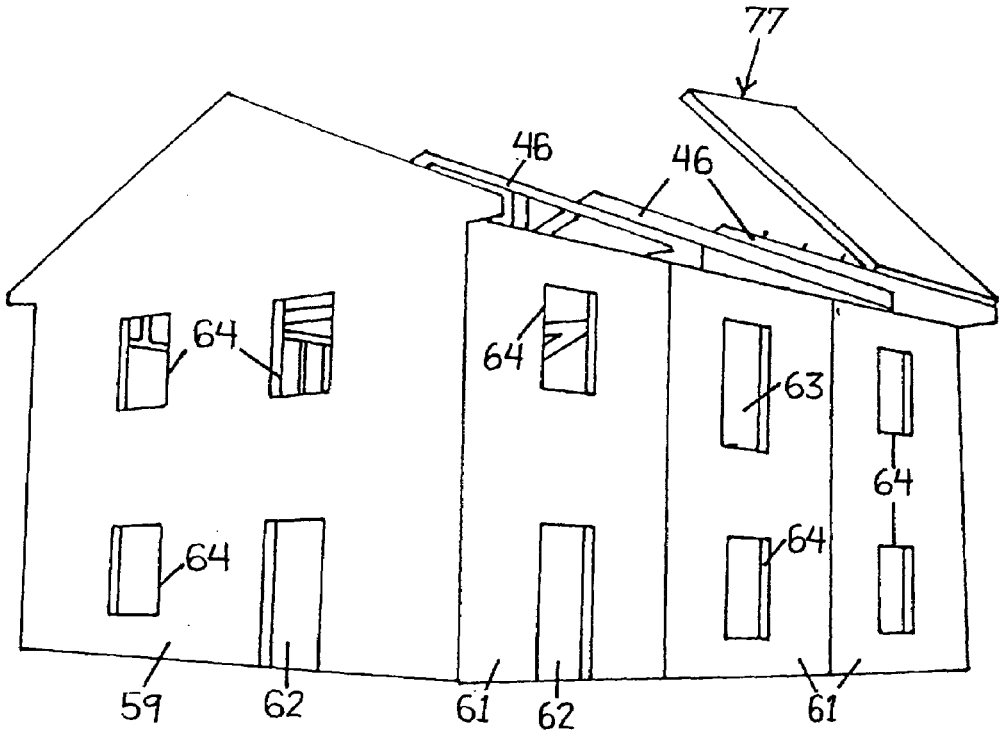
FIG. 13 is a perspective view of the same colonial home with wall panels and end panels installed, and a roof panel being lowered into place.

The wall panels installed in the homes embodying this invention are shown in FIGS. 11, 12, 13. As shown in FIG. 13, these are primarily gable end wall panels 59, three stories high, or side wall panels 61, either of which may have first story entrance doorways 62 framed in them, or second story doorways 63 opening onto balconies or decks, or any desired number of window openings 64.

The steel construction philosophy of the invention is embodied in these wall panels, as shown in FIG. 12. Vertical studs 66 are preferably formed as steel channels or steel I-beams similar to the C channels forming metal floor rafters 56 in FIG. 8, or the metal roof purlins 81 in FIGS. 5, 6, 11 and 26.

Each wall panel 61 of FIG. 12 is provided with sturdy rolled steel channels forming rim members 68, extending vertically along the side edges of each panel, horizontally along the top and bottom edges, and diagonally along the slanting gable edges of gable end panels 59. At corners of the wall panels, these rolled steel channel rim members 68 can be selected for embracing interfits, which can be spot welded, and the stud channels 66 can also be spot welded to rim members 68, and to other stud channels around doorways 62 and 63, or window openings 64.

Figure 19:
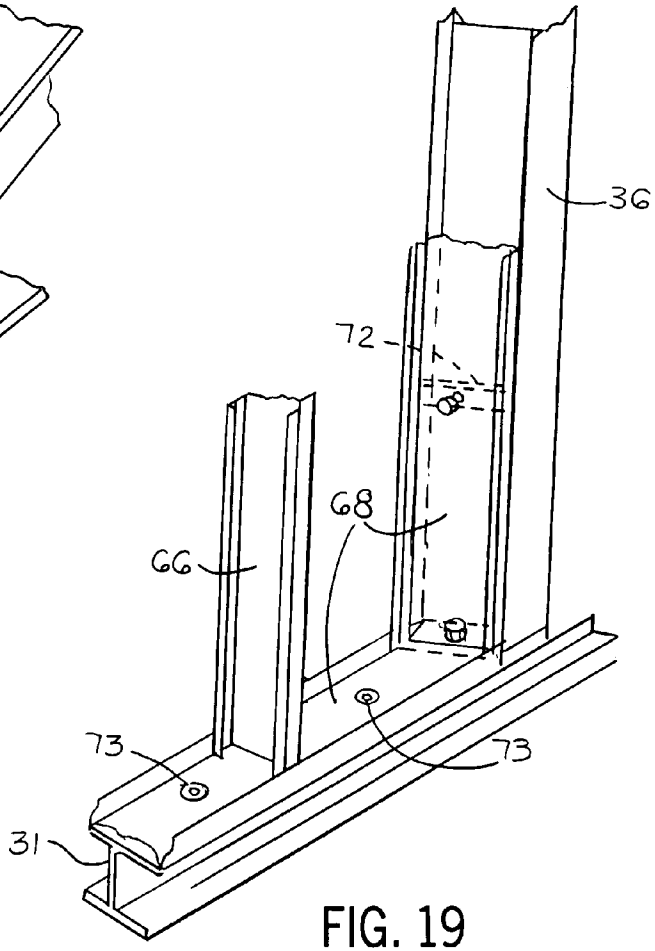
FIG. 19 is an enlarged fragmentary perspective view of a lower corner of the wall panel of FIG. 12, showing the details of its anchored installation.

Wall panels are installed as shown in FIG. 19 between the webs of end frames and/or intermediate frames by aligning predrilled bolt holes 69, formed near the top and bottom of the wall panels' vertical side edge rim members 68, with a predrilled hole 71 in a short bar 72 spanning the space between the flange edges of column 36, and welded thereto. FIGS. 9, 19, 21 and 22 show bar 72, with central hole 71 drilled therethrough, welded in position. FIG. 22 shows a nut 70 welded to the hidden face of bar 72, facing the web of the I-beam, with its internal threads aligned to receive a bolt inserted from the interior of the mating wall panel's side edge rim channel member 68, and torqued into threaded engagement with the nut 70.

After each side wall panel 61 is bolted in position between frames, its lower rim member 68 can be spot welded or plug welded at 73 to the underlying foundation I-beam 31 (FIG. 19).

Bars 72 with their holes 71 can easily be adapted to receive bolts 70 inserted through the side flanges of an A-frame gable end panel's side edge rim member 68. A pair of diagonal reinforcing straps or bars 74 are welded to steel studs 66 and rim members 68 spanning the height and width of each wall panel, as shown in FIGS. 11 and 12, to assure stiffness and rectangularity of the wall panels 59 and 61.

After adding a layer of Tyvek or similar windproof material for insulating value to the outside face of each wall panel 59, 61, any desired surface treatment may be installed: wood shingles, ship lap planking, clapboard siding, board and batten siding, vinyl siding or the like. Insulation may be installed between studs inside panels 59 or 61 before sheetrock or other interior wall surface panels are added.

Roof Beams

The details of roof construction for the A-frame homes are shown in FIGS. 3, 4, 5 and 6.

Similar details of roof construction for the colonial homes are shown in FIGS. 10, 11, 12A, 15, 16, 26 and 27.

Figure 6:
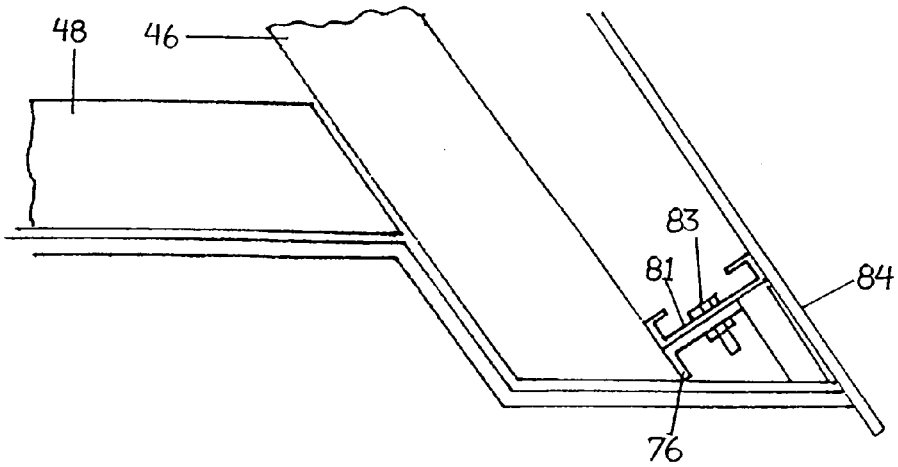
FIG. 6 is an enlarged fragmentary cross-sectional elevation view of construction details of the eave construction.
Figure 15:
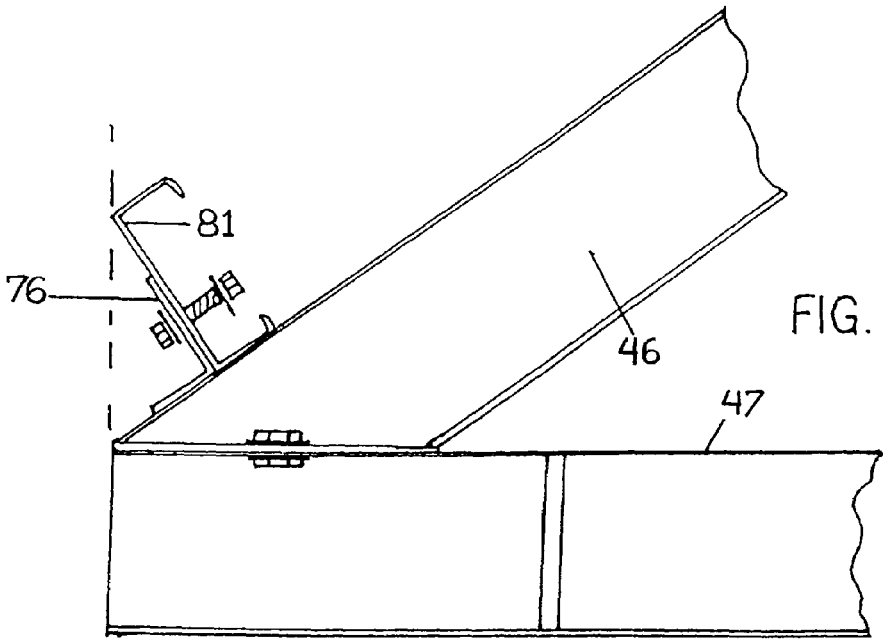
FIG. 15 is a fragmentary enlarged elevation view showing the eave construction details of the roof of the colonial home.

FIGS. 6 and 15 show the upstanding rolled steel angles 76 welded at spaced intervals of about 4 feet along the uppermost external flange surfaces of the roof rafter beams 46, the topmost steel beam in each structural steel frame incorporated in these homes.

On each roof, the lowest of these angles 76 is positioned at the eave edge of beam 46 as seen in FIGS. 9, 11, 14, 15, 18 and 26. Angles 76 all have their bases extending toward the eave edge, positioning the flat faces of their upstanding sections facing the peak of the roof.

Roof Panels

A plurality of prefabricated roof panels 77 are dimensioned for precise alignment with the exposed upper flanges of the roof rafter beams 46. Roof panels 77 are dimensioned with a width to match the spacing between adjacent roof beams 46, corresponding to the width of side wall panels 61, 14 feet, for example.

Each roof panel is provided with peripheral rim channels 78 along its peak edge and its eave edge, and with similar side channels 79 along both of its side edges, channels 78 and 79 may be 8 inch by 14 gage C channels, as shown in the FIGURES, and their ends are preferably overlapped and welded together at the corners of each roof panel. Similar C channels are roof purlins 81 positioned spanning the width of the roof panel at intervals of about 4 feet, with their concave space between their flanges all facing the peak of the roof, and their ends welded to the two roof panel side channels 79.

Figure 18:
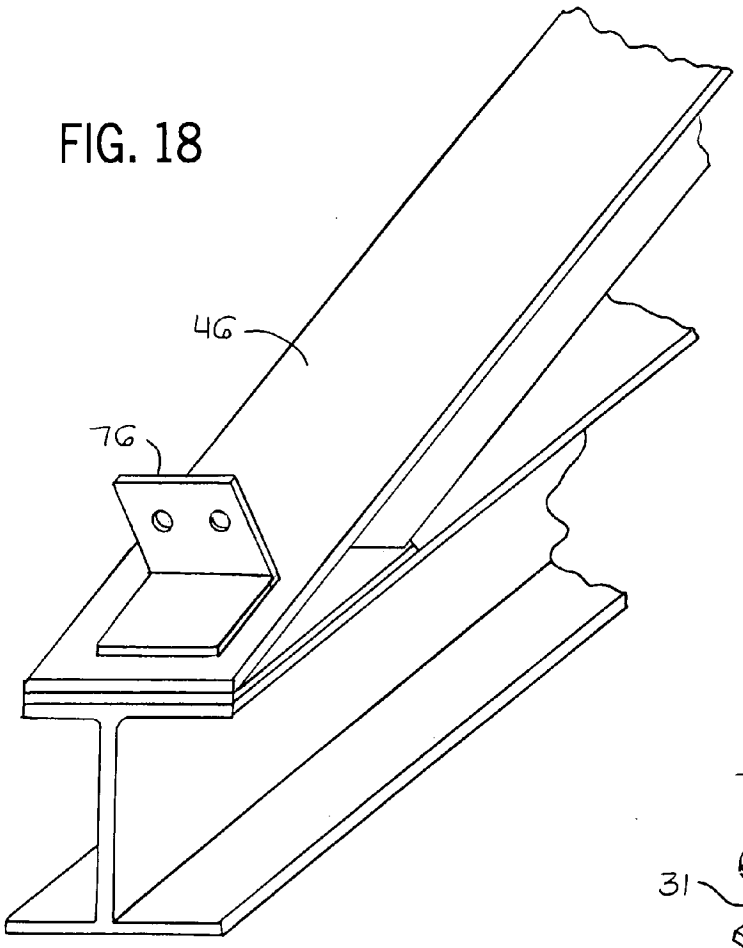
FIG. 18 is an enlarged fragmentary perspective view of the eave frame construction shown in FIGS. 15 and 17.

The intervals between roof purlins 81 are dimensioned to bring their convex flat faces into precise abutting relationship to the flat faces of the upstanding angles 76 on the upper face of the roof rafter beams 46, as indicated in the FIGURES. As shown in FIG. 18 each upstanding roof angle 76 is predrilled with two bolt holes 82 in its upstanding section, to be aligned with corresponding bolt holes in the roof purlins 81, for receiving roof bolts 83 shown in the FIGURES. Two holes 83 are required, because adjacent roof panels have their mating side edges abutting together along the roof rafter beams 46, allowing the first roof panel 77 to be bolted to a roof angle 76 through one bolt hole 83, and the next roof panel 77 to be bolted to the same roof angle 76 through its other bolt hole 83.

As shown in FIGS. 11 and 16, the side rim channels 79 of each roof panel 77 are provided with bolt holes 80 through their webs, for bolted anchoring by bolts 85 to the next roof 77 for side-by-side (FIGS. 14 and 16). A sturdy bolt 75 also holds the flange of each side rim channel 79 to its roof rafter beam 46 (FIG. 14).

Figure 26:
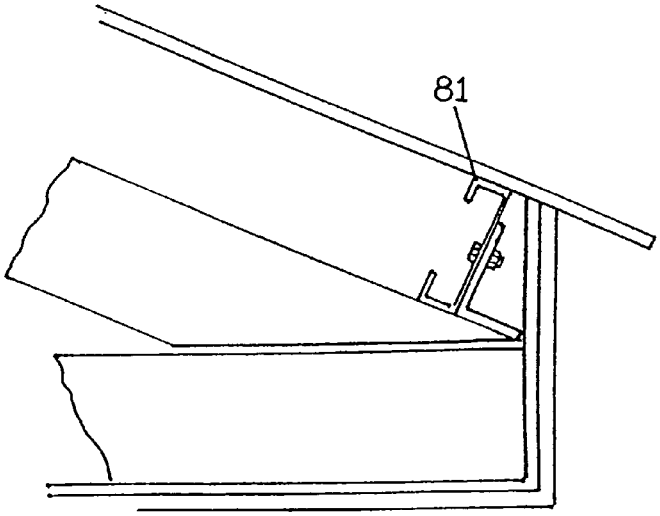
FIG. 26 is a fragmentary cross-sectional elevation view showing construction details of the eaves construction.
Figure 28:
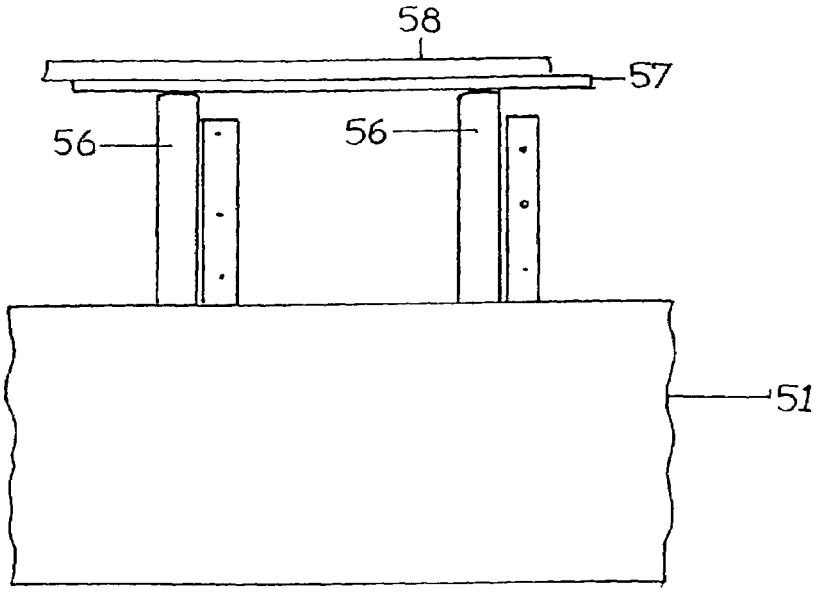
FIG. 28 is a fragmentary cross-sectional elevation view showing construction details of the floor construction.

As shown in the FIGS. 5, 6, 26 and 27, each roof panel 77 has a ¾-inch plywood sheet 84 anchored to the upper flanges of all of its purlins 81, completing the roof construction ready for roofing by shingles or the like. As shown in FIGS. 6 and 26, the eave edge of roof plywood sheet 84 protrudes beyond its lowest angle 76 to provide support for roofing and eave treatment to enclose the eaves against the weather.

The peak edge of each roof plywood sheet 84 is bevelled to mate with the peak edge of the opposite sheet 84 along the peak or ridge of the roof, and an underlying mating ridge member 85*a*, preferably of wood, is joined to the peak edges of both plywood sheets 84 by self-tapping screws 86 (FIG. 16).

Five or six roof angles 76 may be positioned along each roof rafter beam 46 in the colonial home of FIG. 11, while the considerably longer roof rafter beam 46 of the A-frame home may have a dozen angles 76, at shorter intervals of 2 feet, for example.

Two individual roof panels 77 can be positioned one above the other to cover the longer roof height from eave to peak. FIG. 4 shows two roof channel purlins 77 abutting back-to-back, just above the second story floor beam 52 in the A-frame house, and these two abutting purlins can be bolted together to assure the unitary integrity of the A-frame roof.

As each roof panel 77 is lowered at an acute angle position by a crane (FIGS. 11 and 12A), the lowermost eave edge can be brought into sliding contact with the upper surface of roof rafter beam 46 just above the final lowermost eave angle 76, and then lowered until the lowermost roof purlin 81 rests against that angle 76. Further lowering brings the other purlins 81 into alignment and abutting back-to-back engagement with their angles 76, ready for bolted anchoring in place.

Prefabrication and Assembly

After prefabrication of all the component parts, including structural steel I-beams, channels, column beams, roof rafter beams, floor beams and purlins, have been cut to length, predrilled and provided with cap end plates 37 and flange plates 53 all welded in place, and after wall panels with studs and roof panels with purlins have been assembled, corner welded and made ready for installation, and all delivered to the construction site, the assembly process can begin.

Gable end frames are first assembled by bolting columns, floor beams, roof rafter beams, queen posts and frame members for supporting balconies to each other.

The first gable end frame is the first unit to be erected by a crane, and guyed in place by several guy wires after level and vertical plumb lines are verified.

Two-story side wall panels 61 can be added next and bolted to the columns of the gable end frame to form a U-shaped footprint embracing the foundation slab or excavation.

Additional intermediate frames and side wall panels 61 can next be added, and bolted to each other. The side wall panels are not load bearing, since the weight loads of all beams are carried by the rolled steel columns 36. When all side wall panels and intermediate frames are in place, and bolted together, the final gable end frame is added and bolted in place to produce the framed and wall paneled exoskeleton structure shown in FIG. 12A. If wall panels are not bolted in place utilizing bar 72 welded spanning I-beam flanges, the wall panel 14 gage rim channels 68 can be "shot" or nail gunned into the adjacent column I-beam's webs.

Prefabricated roof panels with plywood sheets added can now be lowered into place by crane, and their channel purlins promptly bolted to their abutting angles to rigidify the entire structure. Each roof panel can then be bolted to its adjoining roof panel, completing the exoskeleton of the home.

When plywood is added to the exterior of the wall panels, the structure is ready for the installation of plumbing, heating, airconditioning, lighting fixtures, electric power and communications circuitry and insulation, and then completed with interior wallboard, plywood, sheetrock walls and ceilings, and the construction of flooring, painting and trim.

The homes of this invention are thus uniquely sturdy, being heavy-duty welded or bolted steel boxes, strongly resistant to external loads caused by weather, earthquakes, avalanches or mudslides.

The steel frames and wall panels anchored together by bolts provide lightning rod protection, since a lightning bolt will be conducted through steel frames and components directly to sill beams embedded in earth; isolating the inhabitants from harm.

The advance precutting, predrilling of the structural steel and smaller steel components and their assembly with sturdy nuts and bolts make these components uniquely suited for transport to building sites where they can be quickly assembled into sturdy buildings for military use, headquarters, barracks and compounds. Use for expedition base camps or construction site administrative offices is also entirely practical. They are permanent buildings, but when no longer needed, they can be disassembled, reversing the construction process, and disconnected by removing nuts and bolts, thus preparing the components for transport and storage for future use.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A steel framing and roof enclosure for a residential home, comprising:

two steel gable end frames, spaced apart by the predetermined length of the home, and at least one intermediate steel frame, each said frame comprising a pair of upright columns spaced apart by the predetermined width of the home and having upper ends and lower ends, a pair of diagonally positioned roof rafter beams having higher ends secured together between the upright columns and having lower ends operatively connected respectively to the upper end of one of said columns, each roof rafter beam having an upstanding roof angle secured at the lower end thereof; and a plurality of quadrilateral steel roof panels each framed by a peripheral rim formed by steel channels having their flanges extending inward and their ends secured together to form a quadrilateral rim of each of the roof panels defined by side steel channels dimensioned to match a predetermined portion of the length of the roof rafter beams and top and bottom steel channels dimensioned to fit between the roof rafter beams of adjacent ones of the steel frames, the ends of said top and bottom steel channels resting on the roof rafter beams of adjacent ones of the steel frames and with a plurality of steel roof purlins formed of steel channels extending across each roof panel parallel to its top steel channel and spaced apart at predetermined intervals, the bottom steel channel of each quadrilateral steel roof panel received abutting a roof angle secured at the lower end of the roof rafter beam for positioning the roof panel extending up the roof rafter beam from the lower end of the roof rafter beam and for securing the roof panel to the roof rafter beam.

2. A steel framing, wall and roof enclosure for a residential home, comprising:

two steel gable end frames, spaced apart by the predetermined length of the home, and at least one intermediate steel frame, each said frame comprising a pair of upright columns, spaced apart by the predetermined width of the home, and having upper ends and lower ends, at least one transverse beam spanning the distance between the pair of upright columns, and having its ends respectively sturdily anchored to the pair of upright columns, and a pair of diagonally positioned roof rafter beams having higher ends anchored together at an angle above a midportion of the home's predetermined width, and having lower ends operatively connected respectively to the upper end of one of said pair of upright columns, a plurality of quadrilateral steel wall panels each framed by a peripheral rim formed of steel channels having their flanges directed inward and their ends welded together to form the peripheral rim for the wall panel, defined by side steel channels extending upward for a predetermined proportion of the height of the upright columns, and top and bottom steel channels dimensioned to fit between said upright columns of adjacent ones of said frames, a plurality of upright steel studs arrayed at intervals across the width of each of said plurality of wall panels, and having their ends welded to said top and bottom steel channels, with transverse steel studs spanning the space between two or more upright studs of at least some of the plurality of wall panels to frame window openings and door openings, and a plurality of quadrilateral steel roof panels each framed by a peripheral rim formed by steel channels having their flanges extending inward and their ends welded together to form the peripheral rim for the roof panel defined by side steel channels dimensioned to match a predetermined proportion of the length of the roof rafter beams, and top and bottom steel channels dimensioned to fit between the roof rafter beams of said steel frames with the side steel channels of the roof panels supported on the roof rafter beams of the intermediate frames, with a plurality of steel roof purlins formed of steel channels extending across each roof panel parallel to its top rim and spaced apart at predetermined intervals, with their ends welded to said side steel channels of the roof panels, whereby a first gable end frame of said gable end frames is adapted to be erected and guyed vertically, followed by connecting two of said wall panels respectively to the pair of upright columns of the first gable end frame, facilitating the erection of a first intermediate frame of the at least one intermediate frames with its pair of upright columns connected respectively to the two first wall panels, thereafter followed by connecting two second and additional wall panels to the first and additional intermediate frames in sequence until a desired number of intermediate frames have been erected, thereby further facilitating erecting and connecting the second gable end frame, and installing roof panels between the roof rafter beams of each successive pair of frames, for producing a completely steel framed enclosure for a residential home.

3. The steel framing, wall and roof enclosure defined in claim 2, wherein each gable end frame and each intermediate frame further includes an additional respective transverse beam having both ends respectively anchored to one of said roof rafter beams.

4. The steel framing, wall and roof enclosure defined in claim 3, further including two upstanding queen post I-beams having lower ends anchored respectively near one end of each of said additional respective transverse beams, and having upper ends anchored respectively to the a respective one of the roof rafter beams.

5. The steel framing, wall and roof enclosure defined in claim 2, wherein the at least one intermediate frame is a plurality of said intermediate frames, spaced apart to receive one of the plurality of wall panels between adjacent ones of the plurality of intermediate frames.

6. The steel framing, wall and roof enclosure defined in claim 2, wherein connections between the upright columns, transverse beam and roof rafter beams of the steel gable end frames and intermediate frames include bolt-and-nut connections.

7. The steel framing, wall and roof enclosure defined in claim 6, wherein the upright columns, transverse beams and roof rafter beams of the steel gable end frames and intermediate frames are steel I-beams and connections at the ends of the steel I-beams include cap end plates dimensioned to match the ends of the I-beams and welded thereto, with bolt holes formed in the cap end plates which accommodate the bolt-and-nut connections.

8. The steel framing, wall and roof enclosure defined in claim 2, further including a gable end wall panel dimensioned for anchored connections to an exterior of each gable end frame, and wherein the gable end wall panel is a five-sided panel, with two upper gable rim segments, and with upright steel studs having upper ends welded to said upper gable rim segments.

9. The steel framing, wall and roof enclosure defined in claim 2, wherein each said at least one transverse beam underlying an inhabitable story is formed of a structural steel I-beam whose depth of web and related dimensions are selected to support anticipated floor loads plus required safety factors.

10. The steel framing, wall and roof enclosure defined in claim 9, further including floor rafter beams substantially parallel to said wall panels surmounting the transverse beams of adjacent ones of said frames and positioned at spaced intervals dimensioned to provide stable support for overlying flooring.

11. The steel framing, wall and roof enclosure defined in claim 2, wherein a roof angle is secured to each roof rafter beam at the lower end thereof to receive one of a steel roof purlins and a bottom steel channel of one of the steel roof panels for positioning the steel roof panel on the roof rafter beam.

12. The steel framing, wall and roof enclosure as defined in claim 11, further comprising:

a plurality of roof angles secured to the roof rafter beams of each of the steel gable end and intermediate frames at spaced apart intervals corresponding to predetermined spaced apart distances between steel roof purlins and top and bottom steel channels of the steel roof panels, wherein when the steel roof panels are placed on the roof rafter beams, one of the purlins and bottom steel channels thereof are positioned adjacent the roof angles for securing the steel roof panels to the roof rafter beams.

13. The steel framing, wall and roof enclosure as defined in claim 11, wherein said roof angle comprises a plurality of roof angles secured to the roof rafter beams at spaced apart intervals spaced from the lower ends of the roof rafter beams and corresponding to the predetermined spaced apart intervals of steel roof purlins, such that when the steel roof panels are placed on the roof rafter beams, the steel roof purlins thereof are positioned adjacent the roof angles for securing the steel roof panels to the roof rafter beams.

* * * * *

UNITED STATES PATENT AND TRADEMARK OFFICE

CERTIFICATE OF CORRECTION

PATENT NO. : 7,665,251 B1
APPLICATION NO. : 10/865593
DATED : February 23, 2010
INVENTOR(S) : Steven Lang and Joseph Lang It is certified that error appears in the above-identified patent and that said Letters Patent is hereby corrected as shown below:

*In Column 3, line 58, please add the following:*

FIGURE 9 is a fragmentary enlarged isometric view of one column of the A-Frame of FIGURE 3, showing its associated beams and roof members;

Signed and Sealed this

Twentieth Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,665,251 B1
APPLICATION NO. : 10/865593
DATED : February 23, 2010
INVENTOR(S) : Lang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1401 days.

Signed and Sealed this

Twenty-eighth Day of December, 2010

David J. Kappos

David J. Kappos
*Director of the United States Patent and Trademark Office*